United States Patent [19]

Zanetti

[11] Patent Number: 4,965,947

[45] Date of Patent: Oct. 30, 1990

[54] DEVICE FOR THE DISPLAY OF ADVERTISING MATERIAL

[76] Inventor: Franco Zanetti, Via Delle Grazie 24/A, Brescia, Italy

[21] Appl, No.: 224,272

[22] Filed: Jul. 25, 1988

Related U.S. Application Data

[63] Continuation of Ser. No. 821, Jan. 6, 1987, abandoned.

[30] Foreign Application Priority Data

Jan. 7, 1986 [IT] Italy ..... 5101 A/86

[51] Int. Cl.[5] ..... G09F 11/18

[52] U.S. Cl. ..... 40/471; 40/518; 40/522; 74/526

[58] Field of Search ..... 74/424.8 R, 526; 40/470, 471, 472, 478, 518, 522, 524

[56] References Cited

U.S. PATENT DOCUMENTS

| | | | |
|---|---|---|---|
| 1,310,689 | 7/1919 | Carpenter | 40/171 |
| 1,375,005 | 4/1921 | James et al. | 40/171 |
| 3,145,581 | 8/1964 | Schrecongost et al. | 74/424.8 R |
| 3,510,973 | 5/1970 | Mazzocco, Sr. | 40/471 |
| 3,822,493 | 7/1974 | Maley | 40/471 |
| 4,110,925 | 9/1978 | Strand et al. | 40/471 |
| 4,162,585 | 7/1979 | Decaux | 40/471 |

FOREIGN PATENT DOCUMENTS

| | | | |
|---|---|---|---|
| 2448203 | 10/1980 | France | 40/471 |

*Primary Examiner*—Kenneth J. Dorner
*Assistant Examiner*—J. R. Hakomaki
*Attorney, Agent, or Firm*—McGlew and Tuttle

[57] ABSTRACT

The invention relates to a device for the display of advertising messages which comprises two rollers 7, 8 for winding and unwinding a flexible member (9), such as a sheet which bears advertising messages which can be seen through a front screen, within a body (1) with a transparent front screen (3) which is illuminated from the rear. Each roller (7,8) is driven by a transmission which includes an idling wheel (15, 16, 25, 26) so that when one roller winds up the flexible member the other roller idles thus permitting unwinding of the said member (9).

3 Claims, 3 Drawing Sheets

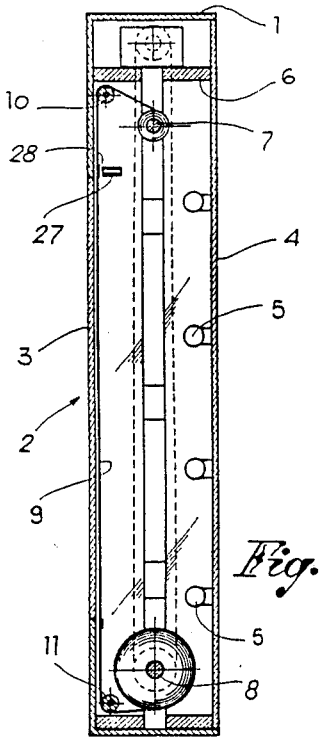
Fig.3
Fig.4
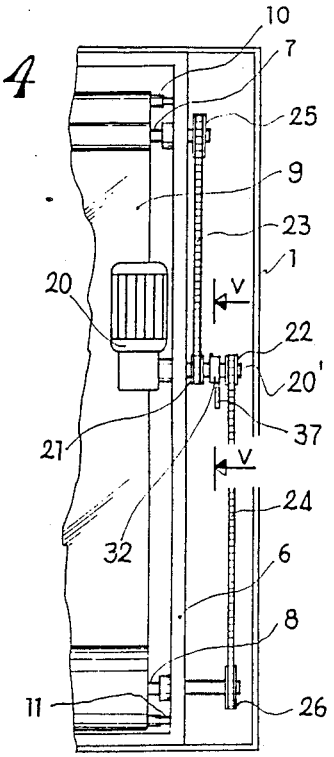
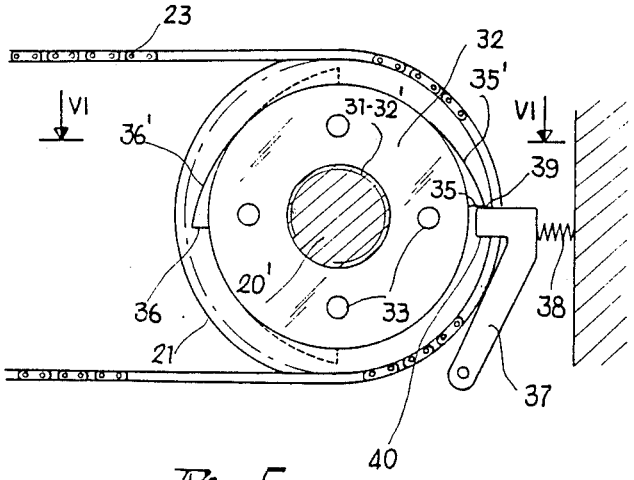
Fig.5

DEVICE FOR THE DISPLAY OF ADVERTISING MATERIAL

This is a continuation of application Ser. No. 000,821, filed Jan. 6, 1987, now abandoned.

FIELD AND BACKGROUND OF THE INVENTION

The present invention relates to a device for the display of advertising messages.

Various forms of devices for the display of repetitive advertising messages have been proposed. Thus, for example, devices which may or may not be luminous, in which the messages are placed on the surfaces of prismatic members rotating about a horizontal or vertical axis to expose the various surfaces and thus the various messages to view in succession, are known.

Devices in which advertising messages are placed on a flexible backing such as an endless film or sheet on supporting and return rollers are also known. One of the rollers is then driven to move the flexible backing always in the same direction and repeatedly advance the messages to at least one window for display.

The above-mentioned devices can, however, only carry a limited number of messages compatible with the number of faces on the prism member in the first case and the length of the endless flexible backing in the latter case, which for structural and dimensional reasons cannot exceed specific dimensions.

The present invention relates to a device for the repeated display of advertising messages and its object is to provide a device which can include an unlimited number of messages within a body of relatively small dimensions with an advantageous reduction in advertising costs.

Another object of the invention is to provide a luminous device for advertising messages which is of simple design and construction and can easily be installed in any place or environment, with the possibility of providing it with the most convenient shape and dimensions in any case.

According to the present invention, there is provided a device for the display of advertising messages comprising a box body having a transparent screen at the front which is illuminated form the rear, in which at least two rotation rollers are mounted with the said body, which rollers alternately wind and unwind a flexible member bearing advertising messages which can be positioned and seen on the front screen, and in which each of the said rollers is driven by a transmission in such a way that where one roller winds the flexible member the other roller idles to unwind the said member.

The various features of novelty which characterize the invention are pointed with particularity in the claims annexed to and forming a part of this disclosure. For a better understanding of the invention, its operating advantages and specific objects obtained by its uses, reference is made to the accompanying drawings and descriptive matter in which a preferred embodiment of the invention is illustrated.

BRIEF DESCRIPTION OF THE DRAWINGS

FIG. 3 is a section taken according to arrows III—III in FIG. 2;

FIG. 4 is a partial view of the device including a variant of the system controlling the winding rollers;

FIG. 5 is a magnified cross-section according to arrows V—V of FIG. 4; and

DETAILED DESCRIPTION OF THE PREFERRED EMBODIMENTS

Figure 1:
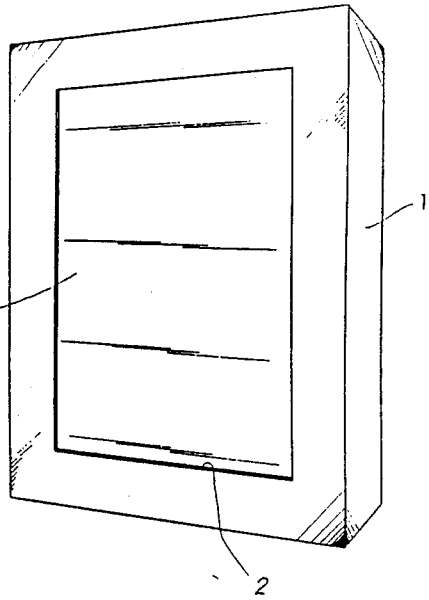
FIG. 1 is a front perspective view of a device in accordance with the invention.

The device in question comprises a box body 1 having at the front at least one display window 2 with a transparent screen 3, and at the rear a panel 4 which carries lamps 5 for the illumination of the screen 3 from behind.

Within the box body 1 is fixed a frame 6 on which are mounted two rotating rollers 7, 8 set in parallel and apart, to which are attached the opposing ends of flexible member 9 in the form of a sheet or film made of any material bearing a plurality of consecutive advertising messages and guided at the sides. Said rollers 7, 8 may be placed horizontally above and below display window 2, respectively, as shown in the drawing. As an alternative, without of course going beyond the scope of the invention, the rollers 7, 8 may also be placed vertically on the right and left-hand sides of the display window 2, respectively.

In any event, said rollers 7, 8 are designed to wind and unwind the flexible member 9 alternately and to cause the latter to run past the front screen 3 with the aid of a pair of diverting rollers 10, 11 in order to display the advertising messages.

Figure 2:
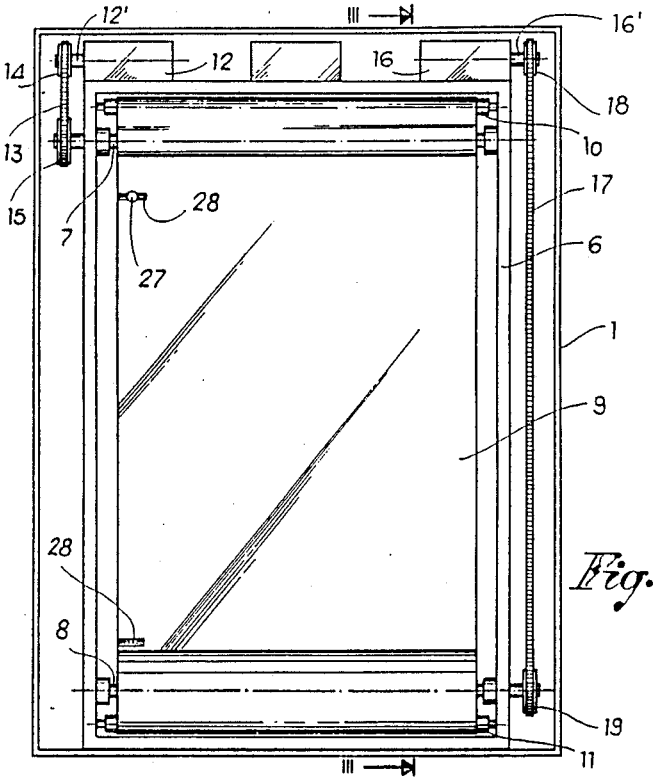
FIG. 2 is a view of the interior of the device before the rear panel has been removed.
Figure 6:
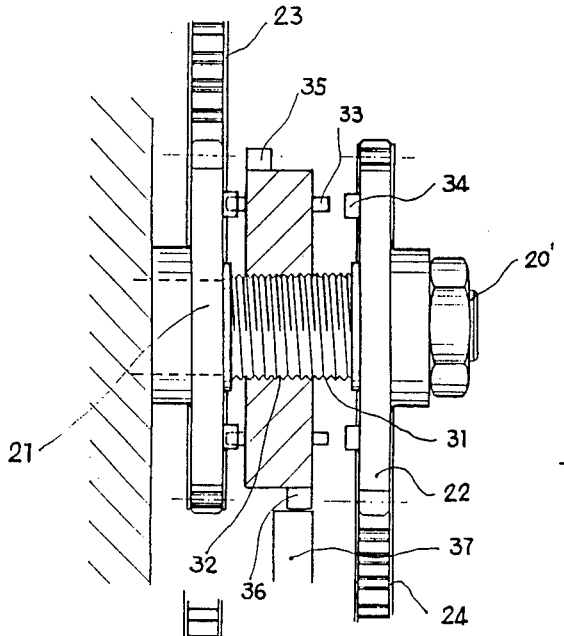
FIGS. 6 and 7 show two different positions of the engaging ring seen according to arrows VI—VI in FIG. 5.
Figure 7:
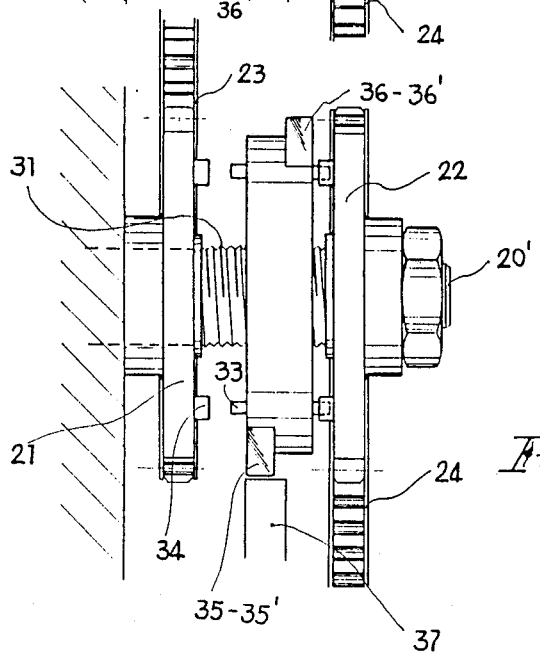

In the embodiment illustrated in FIG. 2, the roller 7 is driven by an electric motor 12 via a chain 13 which runs over a first sprocket 14 keyed to drive shaft 12, and a second idling sprocket 15 mounted at one end of said roller 7. Similarly, the roller 8 is driven by an electric motor 16 via a chain 17 which also runs over a sprocket 18 keyed to drive shaft 16' and another idling sprocket 19 mounted at one end of said roller 8.

Idling sprockets 15, 19 are designed so that when one causes the corresponding driven roller to rotate to wind in flexible member 9 the other idles to allow the corresponding roller to rotate freely and unwind the flexible member.

The two rollers 7, 8 may, however, be driven by a single reversible rotation electric motor 10 as shown in the variant illustrated in FIG. 4. In this case, two sprockets 21, 22 are mounted on drive shaft 20, and drive two idling or fixed sprockets 25,26 mounted at the ends of the rollers 7 and 8 respectively, by means of two chains 23, 24, so that one of the said rollers idles while the other rotates in a direction to wind up flexible member 9 bearing the messages for display. In practice, the two transmissions 23, 24 are driven alternately by motor 20 so that when one is driven the other remains passive or idles.

With this object, and as illustrated in FIGS. 4–7, sprockets 21, 22 are mounted so as to idle on drive shaft 10' of the motor 20 some distance apart. The portion of shaft 20' between the said sprockets is threaded 31 and on this is mounted and moves an engaging ring 32 which has a corresponding internal thread 32'. Engaging ring 32 has drive means 33 on its opposing faces which are designed to engage complementary means 34 provided on the opposing faces of sprockets 21 and 22, the engaging ring being movable alternately to one or other of the said sprockets. Movements of engaging ring 32 are brought about by temporarily stopping it while drive shaft 20, rotates in one direction or the other to produce as screwing/unscrewing effect with movement of the ring along the shaft.

Engaging shaft 32 has on its periphery two radial teeth 35, 36 displaced with respect to each other in a direction parallel to the axis of the ring and facing opposite directions, see FIG. 5. The two teeth 35, 36 are connected to the surface of the ring by means of two bevels or ramps 35', 36' and alternately engage a ratchet pawl 37, e.g. in the form of a lever acted upon by a spring 38, the first when the ring rotates in a clockwise direction with reference to FIG. 5 and the second when the rotation is anticlockwise. Ratchet pawl 37 is of about the same width as a tooth to engage one and the other alternately. In addition to this, it has two catching surfaces 39, 40, an upper one designed to act in association with tooth or shoulder 36 of engaging ring 32, the bevels or ramps 35', 36' of the teeth or shoulders moving aside pawl 37 of the ring without interfering when the latter rotates with motor shaft 10' in a direction opposite to that in the plane of pawl 37.

In practice when engaging ring 37 is alongside and engages with a sprocket, the part can then be driven by motor shaft 20' of the transmission corresponding to that sprocket. The other transmission remains fixed or idles.

When it is wished to activate the other transmission all that is required to reverse the rotation of motor shaft 20'. As a consequence a tooth or shoulder or engaging ring 32 engages ratchet pawl 37. The ring then becomes stationary while the motor shaft rotates. It therefore moves along thread 32' of ring 32 towards the sprocket opposite to the one with which it was previously engaged and engages it thus activating the second transmission once it is free of the pawl.

Thus, flexible member 9 in the form of a sheet or film is wound alternately onto one roller 7 and then the other roller 8 so as to move the advertising messages in succession to the display window 2 where they can be seen as a result of the illumination from the rear.

The advance of flexible member 9 in order to position the advertising messages for display may be controlled e.g. with a photocell 27 acting with indicator areas 28 provided on the said member. Photocell 27, or other equivalent means of control, is incorporated in the electrical circuit of the motor or motors controlling rollers 7, 8 to drive and arrest the latter selectively, possibly in association with a timer designed to control the display time for each message.

While a specific embodiment of the invention has been shown and described in detail to illustrate the application of the principals of the invention, it will be understood that the invention may be embodied otherwise without departing from such principals.

What is claimed is:

1. A display device for advertising messages, comprising a box-shaped body having front, rear, side and end walls, a first roller rotatively mounted in said body a second roller rotatively mounted in said body, each roller being mounted adjacent one of said end walls, a transparent screen extending across said front wall, a flexible member capable of bearing messages having respective ends engaged over an associated said roller and extending over said screen, illumination means in said body for illuminating said member and said screen, drive means in said body connected to each of said rollers for rotating said rollers in selected rotational directions so as to selectively roll and unroll said flexible member thereon said drive means including a drive motor, a drive shaft connected to said drive motor, a firs roller transmission connected to said first roller, a second roller transmission connected to said second roller and engaging means for engaging said drive shaft with one said first and second roller transmissions to drive one of said first and second rollers while another of said first and second rollers idles, an indicator carried by said flexible member, said indicator having a position fixed with respect to a message for positioning said message, a control connected to said drive means for controlling the rolling and unrolling of said flexible member from respective said roller, including a photocell in said body positioned to scan said flexible member and sense said indicator said control means for actuating said drive means, based on the sensed position of said indicator.

2. A device as claimed in claim 1, in which the engaging ring has on its periphery at least two radial teeth placed opposite to each other in a longitudinal direction and facing opposite directions, and in which the said teeth engage alternately with a ratchet pawl to immobilize the engaging ring when the rotation of the drive shaft is reversed so as to achieve a screwing/unscrewing effect with lateral movement of the ring itself towards the sprocket of the transmission which is to be driven, while the other transmission remains inoperative.

3. A display device for advertising messages, comprising: a housing having a front side and end walls, said housing front side defining a display window; a transparent screen extending across said front side over said display window; a first roller rotatively mounted in said body between two of said end walls; a second roller rotatively mounted in said body between said two of said end walls spaced from said first roller; a flexible member adapted to bear messages, said flexible member having respective ends engaged over an associated one of said first and second rollers and extending over said screen; illuminating means positioned within said housing for illuminating said flexible member and said screen; drive means positioned within said housing connected to each of said rollers for rotating said rollers in selected rotational directions so as to selectively roll and unroll said flexible member thereon; said drive means including a drive motor, a drive shaft connected to said drive motor, said drive shaft including a threaded portion, first roller transmission including a first roller drive sprocket freely rotatively mounted on sdi drive shaft on a first side of said threaded portion, a second roller transmission including a second roller drive sprocket freely rotatively mounted on said drive shaft on a second side of said threaded portion, an engaging ring having an internal thread engaging said drive shaft threaded portion, said engaging ring including a peripheral surface having a first set of teeth and a second set of teeth, said engaging ring including a first set of drive elements on one side of said engaging ring, facing of said roller drive sprocket, and including a second set of drive elements on another side of said engaging ring facing said second roller drive sprocket, and teeth engaging means for preventing rotation of said engaging ring, said engaging ring moving into engagement with said first roller drive sprocket upon rotation of said drive shaft in a first direction and moving toward and engaging said second roller drive sprocket upon moving said drive shaft in a second direction; an indicator carried by said flexible member; control means connected to said drive means for controlling the unrolling and rolling of said flexible member from respective said first and second rollers in response to said indicator carried by said flexible member.

* * * * *